US008336892B2

(12) United States Patent
Croskey

(10) Patent No.: US 8,336,892 B2
(45) Date of Patent: Dec. 25, 2012

(54) SKATE BRAKE

(76) Inventor: Mark Croskey, San Fernando, CA (US)

( * ) Notice: Subject to any disclaimer, the term of this patent is extended or adjusted under 35 U.S.C. 154(b) by 362 days.

(21) Appl. No.: 12/721,820

(22) Filed: Mar. 11, 2010

(65) Prior Publication Data

US 2010/0314845 A1 Dec. 16, 2010

Related U.S. Application Data

(60) Provisional application No. 61/268,549, filed on Jun. 15, 2009.

(51) Int. Cl.
*A63C 17/14* (2006.01)

(52) U.S. Cl. ..... 280/11.209; 280/809

(58) Field of Classification Search ..... 280/11.204, 280/11.205, 11.206, 11.207, 11.208, 11.209, 280/11.211, 11.215, 11.216, 11.217, 825, 280/809
See application file for complete search history.

(56) References Cited

U.S. PATENT DOCUMENTS

| | | | | | |
|---|---|---|---|---|---|
| 3,112,119 | A | * | 11/1963 | Sweet | 280/11.209 |
| 3,900,203 | A | * | 8/1975 | Kukulowicz | 280/11.205 |
| 5,088,748 | A | | 2/1992 | Koselka et al. | |
| 5,171,032 | A | | 12/1992 | Dettmer | |
| 5,207,438 | A | * | 5/1993 | Landers | 280/11.206 |
| 5,280,931 | A | * | 1/1994 | Horton | 280/11.206 |
| 5,335,924 | A | | 8/1994 | Richards, Sr. et al. | |
| 5,342,071 | A | | 8/1994 | Soo | |
| 5,413,362 | A | | 5/1995 | De Santis | |
| 5,470,085 | A | | 11/1995 | Meibock et al. | |
| 5,551,711 | A | | 9/1996 | Mangelsdorf | |
| 5,582,418 | A | | 12/1996 | Closser | |
| 5,630,595 | A | | 5/1997 | Perner | |
| 5,657,999 | A | | 8/1997 | Beaulieu | |
| 5,791,663 | A | * | 8/1998 | Klukos | 280/11.206 |
| 5,791,665 | A | | 8/1998 | Mayer, II | |
| 5,865,445 | A | | 2/1999 | Svensson et al. | |
| 5,927,728 | A | | 7/1999 | Gignoux et al. | |
| 5,971,406 | A | * | 10/1999 | Lyman | 280/11.221 |
| 6,047,973 | A | | 4/2000 | Amore et al. | |
| 6,874,794 | B2 | | 4/2005 | Holland | |
| 2001/0000935 | A1 | * | 5/2001 | Bozinovic | 280/11.206 |
| 2008/0238007 | A1 | * | 10/2008 | Wang | 280/11.215 |

OTHER PUBLICATIONS

QuadStop Skate Front Brake Pad; http://www.skates, com/QuadLine-Front-Skate-Brakes-p/qd673b.htm; at least as earlier as Jan. 25, 2009; 2 pages.

Skids—Inline Skate Brake; http://inventorspot.com / inventions_skids_inline_skate_brake_3542; 2000; 2 pages.

A Front Brake for In-Line Skates; http://query.nytimes.com/gst/fullpage.html? res=9EO3EEDA113FF934A25754COA962958260&n=Top%2FReference%2FTimes%20Topics%2FSubjects%2FB%2FBrakes; Jul. 17, 1994; 2 pages.

* cited by examiner

*Primary Examiner* — Frank Vanaman
(74) *Attorney, Agent, or Firm* — Brown & Michaels, PC

(57) ABSTRACT

A brake assembly for a skate of the type having parallel rails connected to the bottom of a boot. The skate brake bracket for mounting outside the rails and a brake wheel mounted to the skate brake bracket. The tension of the brake wheel may be adjusted.

4 Claims, 6 Drawing Sheets

SKATE BRAKE

REFERENCE TO RELATED APPLICATIONS

This application claims one or more inventions which were disclosed in Provisional Application No. 61/268,549, filed Jun. 15, 2009, entitled "FRONT BRAKE 4 INLINE SKATE". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of skates. More particularly, the invention pertains to a skate brake.

2. Description of Related Art

Prior art skate brakes commonly consist of rubber pads on the front of the skates. The rubber pads wear out frequently and have to be replaced. Additionally, the tension of the rubber pads used as brakes are not adjustable to suit the terrain or the weight of the skater.

SUMMARY OF THE INVENTION

A brake assembly for a skate of the type having parallel rails connected to the bottom of a boot. The skate brake bracket for mounting outside the rails and a brake wheel mounted to the skate brake bracket.

The skate brake bracket is placed on the outer sides of the parallel rails of the inline skate and has first and second connecting portions and first and second brake holding portions. The connecting portions have a series of holes aligned with the plurality of wheels of the inline skate and receive brake bolts which can substitute for the skate's wheel bolts. The first and second brake holding portions are integrally connected to the first and second connecting portions and extending away from and forward of the inline skate boot and at least partially across the path of the forward most skate wheel. A first brake holding portion receives a tension adjuster screw and the second brake holding portion receives a tensioner. The brake wheel is rotatably mounted to a tension adjuster screw between two washers and the brake holding portions. Tension on the brake wheel is applied by the washers and the tensioner on the brake wheel. The tension on the brake wheel may be adjusted by adjusting the tensioner adjuster screw relative to the tensioner.

DETAILED DESCRIPTION OF THE INVENTION

Figure 1:
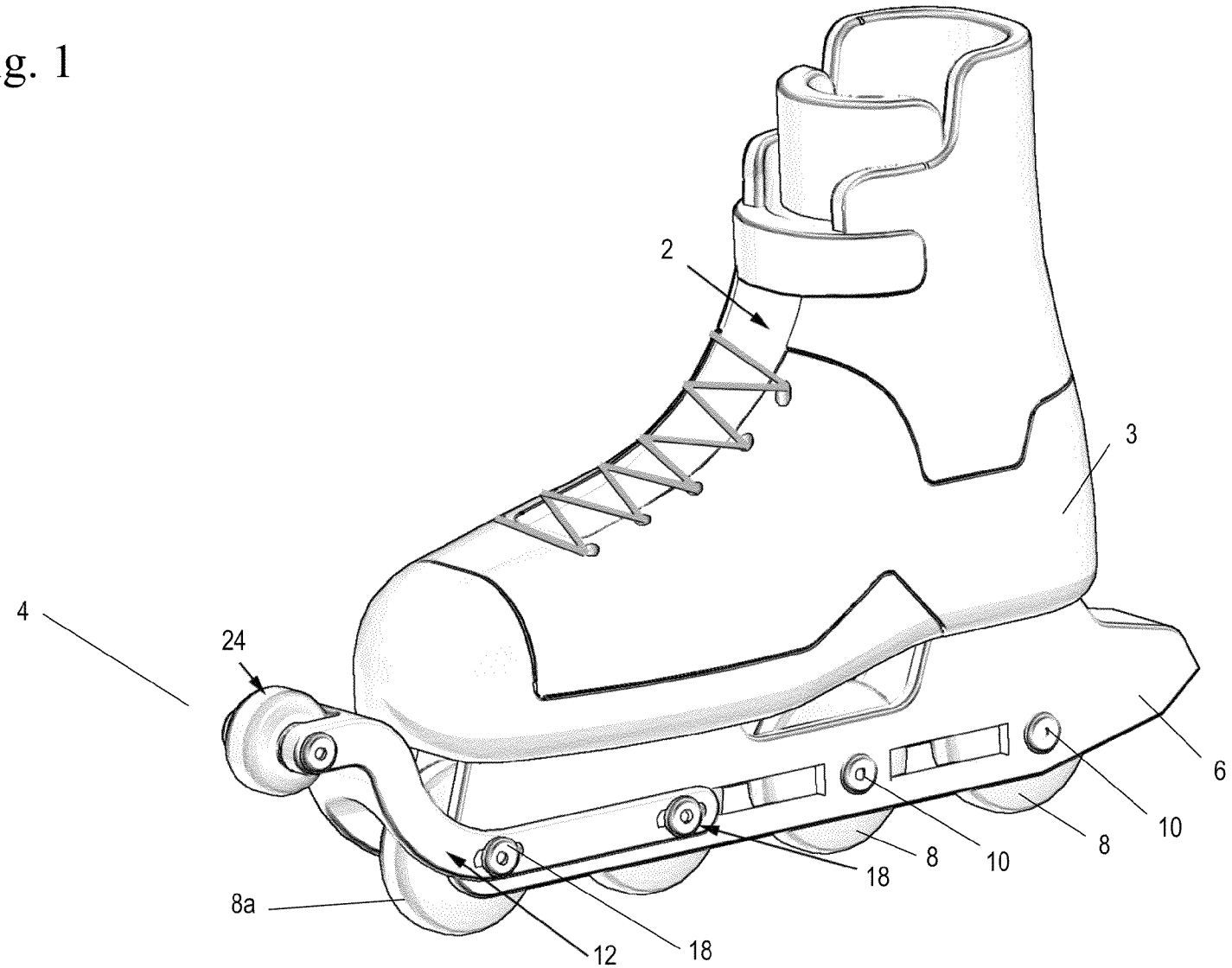
FIG. 1 shows a schematic of the brake on an inline skate.
Figure 2:
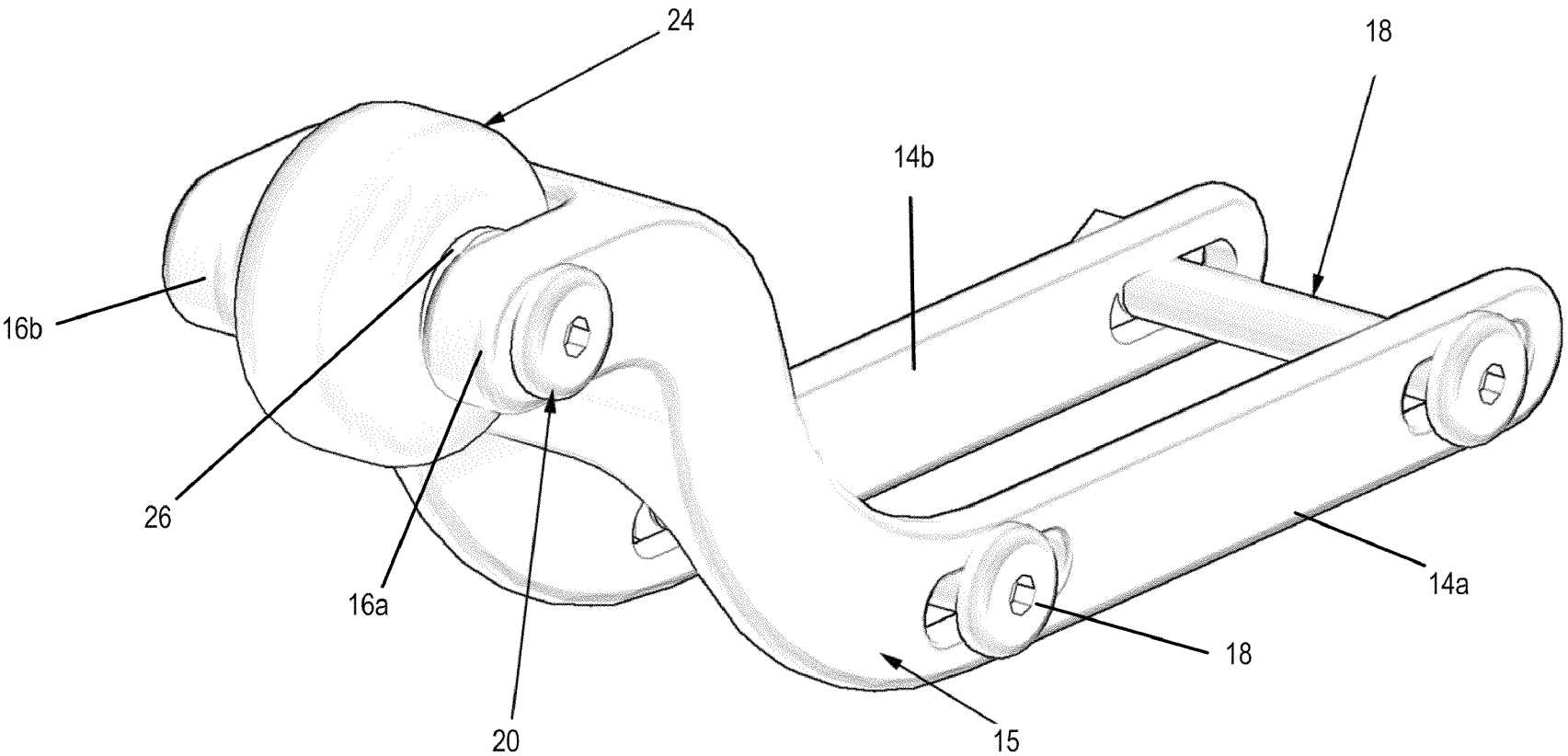
FIG. 2 shows a schematic of the brake.
Figure 3:
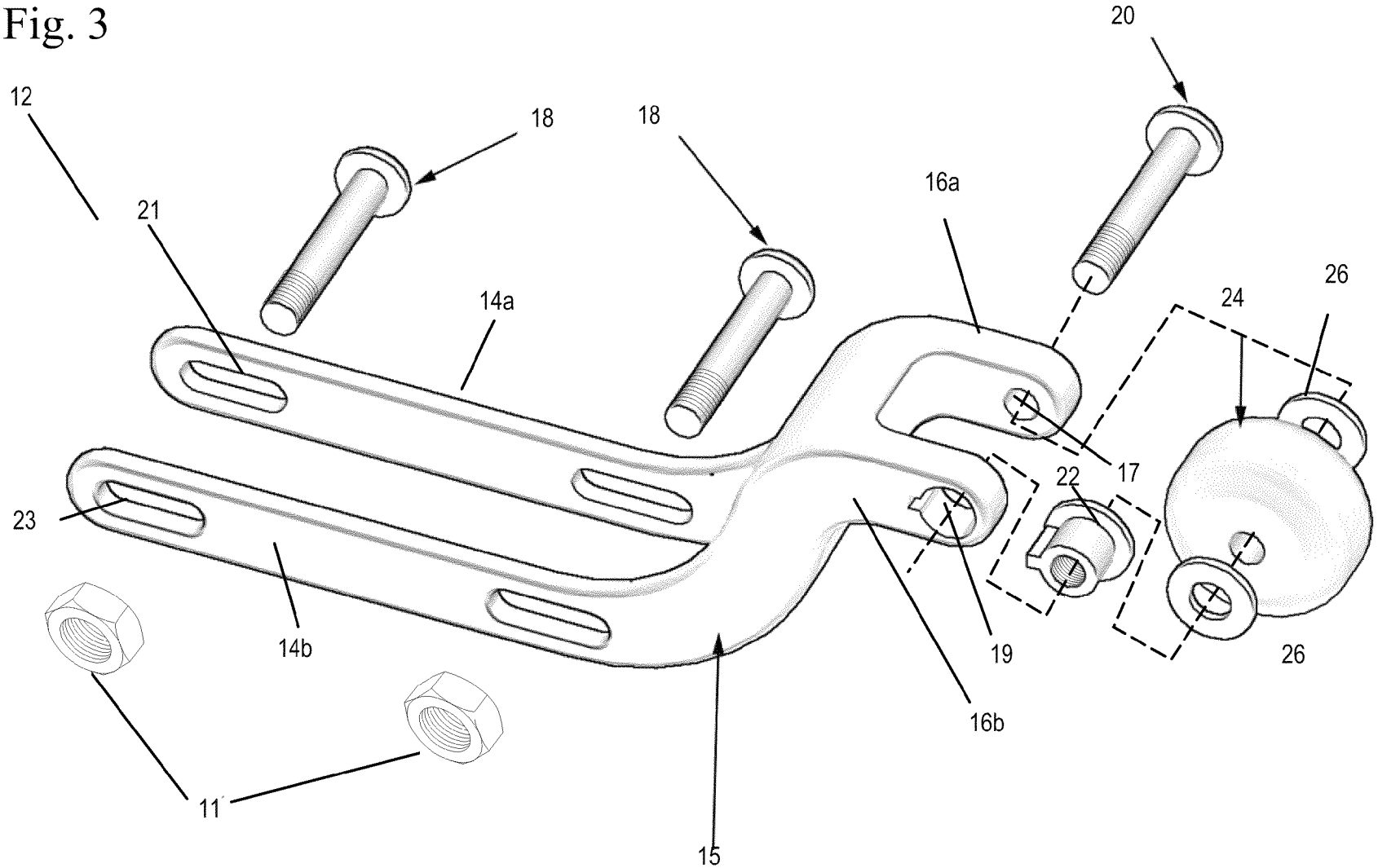
FIG. 3 shows an exploded view of the brake of FIG. 2.
Figure 4:
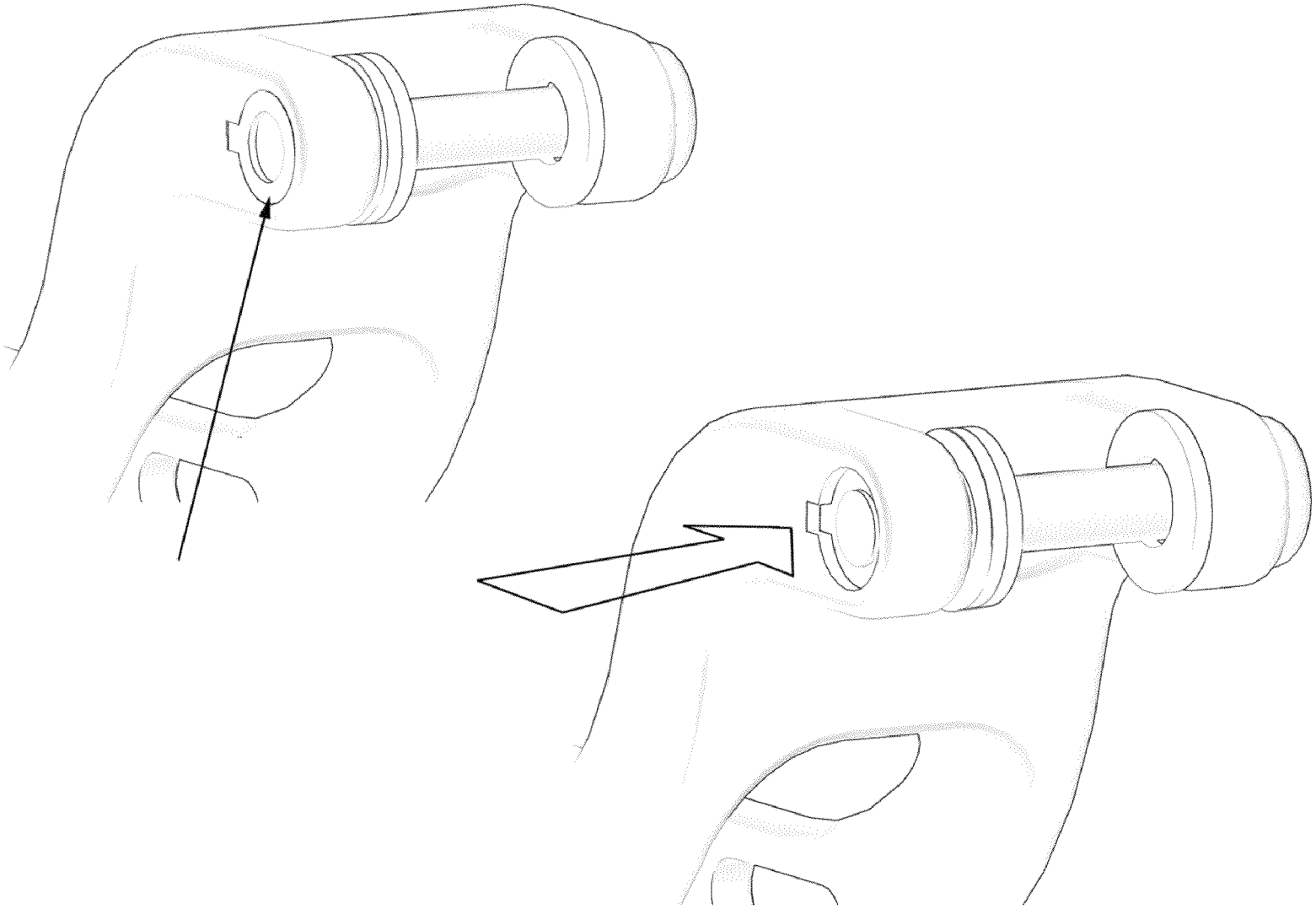
FIG. 4 shows a detailed view of the tensioner of the brake.

FIGS. 1-4 show an inline skate 2 with a brake assembly 4. The inline skate 2 is a skate of a conventional type and is not limited to the boot design shown in the Figures. Connected to the bottom of the boot 3 of the inline skate 2 are two parallel rails 6. The rails 6 support a plurality of wheels 8 with wheel bolts 10, which may range from two wheels up to four or more. Attached to outer sides of the two parallel rails 6 is a skate brake bracket 12.

The skate brake bracket 12 has first and second connecting portions 14*a*, 14*b* and first and second brake holding portions 16*a*, 16*b* for placement on the outer sides of the two parallel rails 6 of the inline skate 2. The first and second connecting portions 14*a*, 14*b* are preferably integrally connected to the brake first and second holding portions 16*a*, 16*b* through curved portions 15 that are concavely curved away from the inline skate boot 3 to allow for a clearance between the toe of the inline skate boot 3 and the skate brake bracket 12 and extends forward from the toe of the inline skate boot 3 and at least partially across the path of the forward skate wheel 8*a*.

The first and second connecting portions 14*a*, 14*b* of the skate brake bracket 12 have a series of holes 21, 23 that align with the wheels 8 of the inline skate 2 in order to attach the skate brake bracket 12 to the inline skate 2. The holes 21, 23 are elongated in shape to allow for some variation of wheel to wheel dimensions which may be present between different brands of inline skates. Alternatively, multiple holes may be present in order to allow for the brake to be attached to different brands of inline skates.

To attach the brake assembly 4 of the present invention to the conventional inline skate 2, the wheel bolts 10 from the first two wheels 8, 8*a* are preferably removed and substituted with first and second brake bolts 18, although the wheel bolts may also work. Alternatively, the first and second brake bolts 18 may be placed in between the plurality of wheels 8.

The first and second brake bolts 18 are preferably made of steel and are longer than the wheel bolts 10 originally present. The nuts 11 that were paired with the wheels 8, 8*a* of the inline skate 3 are reused and tightened to fasten the first and second connecting portions 14*a*,14*b* of the skate brake bracket 12 into place on the two parallel rails 6. The skate brake bracket 12 is preferably formed of aluminum, although other materials such as plastic, fiberglass, round bar, stainless steel powder, or ultra high molecular weight polyethylene (UMHW) may be used. The material of the skate brake may be colored using techniques known in the art.

The first brake holding portion 16*a* of the skate brake bracket 12 has a hole 17 for receiving a threaded tension adjuster screw 20 and the second brake holding portion 16*b* of the skate brake bracket 12 has a hole 19 for receiving a threaded tensioner 22 that is aligned with the hole 17 and receives the threaded tension adjuster screw 20. A brake wheel 24, preferably made of rubber or plastic and smaller in size and diameter than the wheels 8, 8*a* of the inline skate 2, is received between the first and second brake holding portions 16*a*, 16*b* of the skate brake bracket 12. Two washers 26, also preferably made of rubber, are present between the first and second brake holding portions 16*a*, 16*b* and the brake wheel 24. The brake wheel 24 is the brake for the inline skate 2 and is preferably attached to the brake assembly 4 by placing the brake wheel 24 between the first and second brake holding portions 16*a*, 16*b* and two washers 26, one on each side of the brake wheel 24 and placing the tension adjuster screw 20 through the hole 17 on the first brake holding portion 16*a*, the washer 26, the brake wheel 24, the other washer 26 and through tensioner 22 received in the opposite hole 19 in the second brake holding portion 16*b*. Then, the tensioner adjuster screw 20 is tightened securing the brake wheel 24 into place between the first and second brake holding portions 16*a*, 16*b*.

The washers 26 sandwiched between the first and second brake holding portions 16*a*, 16*b* and the brake wheel 24 control the tension of the spin of the brake wheel 24. Tightening the tensioner adjuster screw 20 draws the tensioner 22 and the washers 26 against the brake wheel 24, applying pressure on the brake wheel 24 and controlling how much if any spin of the brake wheel 24 occurs. Therefore, the skater may adjust the tension of the brake of their inline skate 2 easily and for whatever terrain they may be skating on.

If more tension is required, for a harder stop, for example when skating on hilly terrain, then the skater tightens the tensioner adjuster screw 20, drawing the tensioner 22 and the washers 26 against the brake wheel 24 and prevents any significant spinning of the brake wheel 24 when the skater flexes their foot to apply pressure on the toe, such that the toe of the skate 2 moves downwards towards the ground and the brake wheel 24 engages the ground. If less tension is required, for a softer stop, for example when skating on flat terrain where a quick stop may be easier to execute, then the skater may loosen the tensioner adjuster screw 20, removing some of the force of the washer 26 and tensioner 22 on the brake wheel 24.

By being able to control the tension and the spin of the brake wheel 24 the skater can also adjust the braking of the inline skate 2 for the weight of the skater.

Figure 5:
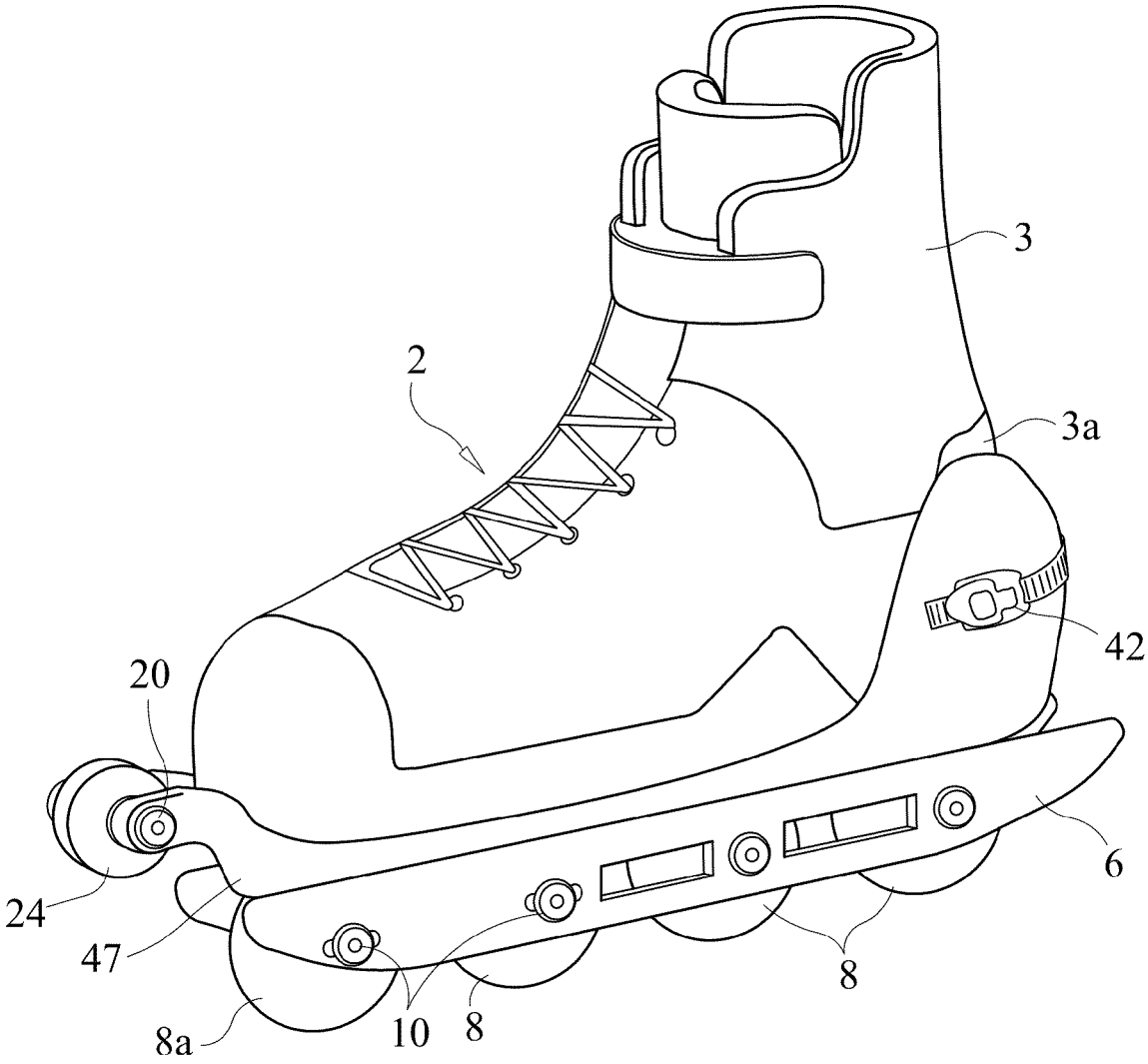
FIG. 5 shows a schematic of a brake of an alternate embodiment.
Figure 6:
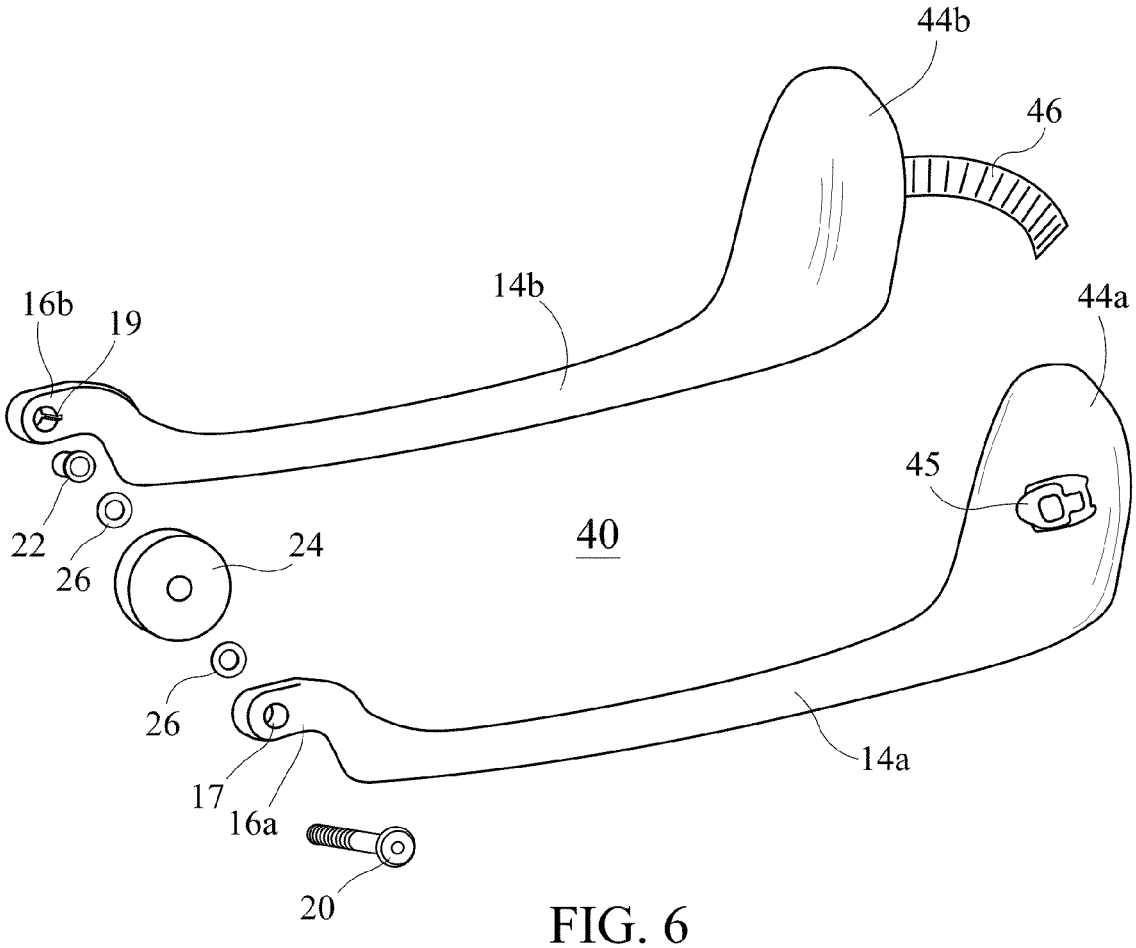
FIG. 6 shows an exploded view of the brake of FIG. 5.

FIGS. 5 and 6 show a brake assembly 40 of a second embodiment. Instead of the brake assembly 4 being attached to the rails 6 that support a plurality of wheels 8 as shown in FIGS. 1-4, the brake assembly 40 is attached to skate 2 by a ratchet means 42. The ratchet means 42 is shown as being at the heel 3*a* of the skate boot 3 although the ratchet means 42 may be placed anywhere on the skate that adequately attaches the brake assembly to the skate. Additionally, the first and second connecting portions 14*a*, 14*b* extend to and are coupled to first and second heel cup portions 44*a*, 44*b* that are joined together by a ratchet means 42 consisting of a ratchet buckle 45 on a first heel cup portion 44*a* and a strap 46 on the second heel cup portion 44*b*.

The inline skate 2 is a skate of a conventional type and is not limited to the boot design shown in the Figures. Connected to the bottom of the boot 3 of the inline skate 2 are two parallel rails 6. The rails 6 support a plurality of wheels 8 with wheel bolts 10, which may range from two wheels up to four or more.

The skate brake bracket 47 has first and second connecting portions 14*a*, 14*b* and first and second brake holding portions 16*a*, 16*b* for placement on the outer sides of the two parallel rails 6 of the inline skate 2 above the plurality of wheels 8. The first and second connecting portions 14*a*, 14*b* are preferably integrally connected to the brake first and second holding portions 16*a*, 16*b* through curved portions 15 that are concavely curved away from the inline skate boot 3 to allow for a clearance between the toe of the inline skate boot 3 and the skate brake bracket 47 and extends forward from the toe of the inline skate boot 3 and at least partially across the path of the forward skate wheel 8*a*. As previously stated, the first and second connecting portions 14*a*, 14*b* are also preferably connected to first and second heel portions 44*a*, 44*b*.

To attach the brake assembly to the conventional inline skate, the ratchet means 44 is undone and the first and second connecting portions 14*a*, 14*b* of the skate brake bracket 47 are placed on the two parallel rails 6 above the holes with bolts 10 that attached the wheels 8 to the skate 2, such that the skate brake bracket 47 extends forward from the toe of the inline skate and the brake wheel 24 is at least partially across the path of the forward skate wheel 8*a*, and the strap 46 on the second heel cup portion 44*b* is received by a ratchet buckle 45 on a first heel cup portions 44*a*, tightening the brake assembly 40 to the skate 2.

Alternatively, the brake assembly 40 may be attached to a conventional skate with at least one set of parallel wheels (not shown). The brake assembly 40 may be attached to the skate by undoing the ratchet means 42 and placing the first and second connecting portions 14*a*, 14*b* of the skate brake bracket 47 adjacent to a bracket supporting the wheels, such that the skate brake bracket 47 extends forward from the toe of the skate and the brake wheel 24 is inline with the toe of the skate, and the strap 46 on the second heel cup portion 44*b* is received by a ratchet buckle 45 on a first heel cup portions 44*a*, tightening the brake assembly 40 to the skate 2.

The skate brake bracket 47 is preferably formed of aluminum, although other materials such as plastic or ultra high molecular weight polyethylene (UMHW) may be used.

The braking of the skate using the brake wheel works as described in reference to FIGS. 1-4. The first brake holding portion 16*a* of the skate brake bracket 12 has a hole 17 for receiving a threaded tension adjuster screw 20 and the second brake holding portion 16*b* of the skate brake bracket 12 has a hole 19 for receiving a threaded tensioner 22 that is aligned with the hole 17 and receives the threaded tension adjuster screw 20. A brake wheel 24, preferably made of rubber or plastic and smaller in size and diameter than the wheels 8, 8*a* of the inline skate 2, is received between the first and second brake holding portions 16*a*, 16*b* of the skate brake bracket 12. Two washers 26, also preferably made of rubber, are present between the first and second brake holding portions 16*a*, 16*b* and the brake wheel 24. The brake wheel 24 is the brake for the inline skate 2 and is preferably attached to the brake assembly 4 by placing the brake wheel 24 between the first and second brake holding portions 16*a*, 16*b* and two washers 26, one on each side of the brake wheel 24 and placing the tension adjuster screw 20 through the hole 17 on the first brake holding portion 16*a*, the washer 26, the brake wheel 24, the other washer 26 and through tensioner 22 received in the opposite hole 19 in the second brake holding portion 16*b*. Then, the tensioner adjuster screw 20 is tightened securing the brake wheel 24 into place between the first and second brake holding portions 16*a*, 16*b*.

The washers 26 sandwiched between the first and second brake holding portions 16*a*, 16*b* and the brake wheel 24 control the tension of the spin of the brake wheel 24. Tightening the tensioner adjuster screw 20 draws the tensioner 22 and the washers 26 against the brake wheel 24, applying pressure on the brake wheel 24 and controlling how much if any spin of the brake wheel 24 occurs. Therefore, the skater may adjust the tension of the brake of their inline skate 2 easily and adjust for whatever terrain they are skating on.

If more tension is required, for a harder stop, for example when skating on hilly terrain, then the skater tightens the tensioner adjuster screw 20, drawing the tensioner 22 and the washers 26 against the brake wheel 24 and prevents any significant spinning of the brake wheel 24 when the skater flexes their foot to apply pressure on the toe, such that the toe of the skate 2 moves downwards towards the ground and the brake wheel 24 engages the ground. If less tension is required, for a softer stop, for example when skating on flat terrain where a quick stop may be easier to execute, then the skater may loosen the tensioner adjuster screw 20, removing some of the force of the washer 26 and tensioner 22 on the brake wheel 24.

By being able to control the tension and the spin of the brake wheel 24 the skater can also adjust the braking of the inline skate 2 for the weight of the skater.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A brake assembly for a skate of the type having parallel rails connected to the bottom of a boot having a heel comprising:

a) a skate brake bracket for mounting on outer sides of the parallel rails comprising:

i) connecting portions extending a length of the skate to the heel;

ii) first and second heel portions coupled to the connecting portions surrounding the heel of the boot, the first heel portion having a strap and a second heel portion having a ratchet buckle for receiving the strap and attaching the skate brake bracket to the skate;

iii) first and second brake holding portions integrally connected to the connecting portions and extending away from and forward of the skate boot, the first brake holding portion having a first hole and the second brake holding portion having a second hole; a tension adjuster screw threaded into and passing through the second hole in the second brake holding portion and into a tensioner;

b) a brake wheel rotatably mounted on the tension adjuster screw between the first and second brake holding portions;

wherein tension applied by the tensioner on the brake wheel is adjusted by adjusting the tensioner adjuster screw in the tensioner.

2. The brake assembly of claim 1, wherein the connecting portions are integrally connected to the first and second brake holding portions through a portion that is curved away from the boot such that a clearance is present between the boot and the first and second brake holding portions.

3. The brake assembly of claim 1, further comprising a first washer between the brake wheel and the first brake holding portion and a second washer between the brake wheel and the second brake holding portion.

4. The brake assembly of claim 1, wherein the first and a second brake holding portions extend at least partially across a path of a forward most skate wheel.

* * * * *